United States Patent [19]

Gilman et al.

[11] 4,011,081

[45] Mar. 8, 1977

[54] DIRECT-POSITIVE DOUBLE EXPOSURE PROCESS UTILIZING A PRIMITIVE, UNFOGGED SILVER HALIDE EMULSION CONTAINING AN ELECTRON ACCEPTOR

[75] Inventors: Paul B. Gilman, Rochester, N.Y.; John V. Morgan, Burnsville, N.C.

[73] Assignee: Eastman Kodak Company, Rochester, N.Y.

[22] Filed: Mar. 3, 1975

[21] Appl. No.: 554,932

Related U.S. Application Data

[63] Continuation-in-part of Ser. No. 398,906, Sept. 19, 1973, abandoned, which is a continuation of Ser. No. 154,155, June 17, 1971, abandoned.

[52] U.S. Cl. ..... 96/45.2; 96/64; 96/101

[51] Int. Cl.[2] ..... G03C 5/32; G03C 5/24

[58] Field of Search ..... 96/101, 64, 45.2

[56] References Cited

UNITED STATES PATENTS

| | | | |
|---|---|---|---|
| 2,263,002 | 11/1941 | Knott | 96/101 |
| 3,501,307 | 3/1970 | Illingsworth | 96/101 |
| 3,736,140 | 5/1973 | Collier et al. | 96/101 |
| 3,761,276 | 9/1973 | Evans | 96/64 |

OTHER PUBLICATIONS

Farnell et al.: Low Level Chemical Sensitization, J. Phot. Sci., vol. 11, 1963, pp. 57–64.

Maurer et al., A Photographic Low Intensity Desensitization Effect, J. Optical Soc. of America, vol. 42, No. 6, June, 1952, pp. 402–408.

*Primary Examiner*—Won H. Louie, Jr.

*Attorney, Agent, or Firm*—Carl O. Thomas

[57] ABSTRACT

Processes are disclosed for obtaining positive images in an unfogged, primitive, silver halide emulsion wherein a photographic element comprising a support and said emulsion are imagewise-exposed with a low-intensity light, given an over-all flash exposure with a high-intensity light and developed in a silver halide developer. In one aspect, the silver halide emulsions of this invention are primitive, unfogged, silver halide emulsions which comprise an electron acceptor.

4 Claims, No Drawings

DIRECT-POSITIVE DOUBLE EXPOSURE PROCESS UTILIZING A PRIMITIVE, UNFOGGED SILVER HALIDE EMULSION CONTAINING AN ELECTRON ACCEPTOR

CROSS-REFERENCE TO RELATED APPLICATIONS

This is a continuation-in-part of application Ser. No. 398,906, filed Sept. 19, 1973, now abandoned, which is a continuation of application Ser. No. 154,155, filed June 17, 1971, now abandoned.

This invention relates to silver halide emulsions and methods of forming positive images in silver halide emulsions. In one aspect, this invention relates to a system for forming positive images which utilizes a photographic element having at least one layer containing an unfogged, primitive, silver halide composition and a densensitizer or an electron acceptor. In another aspect, this invention relates to an improved method of obtaining positive images wherein an unfogged, primitive, silver halide composition containing a densensitizer or electron acceptor is imagewise-exposed and then is given a light flash before development in a surface developer.

Processes are known in the art for making positive images in unfogged silver halide emulsions. Typical processes of this type are disclosed in U.S. Pat. No. 2,497,875 by Falleson issued Feb. 21, 1950; U.S. Pat. No. 2,588,982 by Ives issued Mar. 11, 1952; and U.S. Pat. No. 2,456,953 by Knott et al. issued Dec. 21, 1948; British Pat. No. 1,151,363; and Japanese Pat. No. 29,405/68 issued Dec. 17, 1968. Generally, the prior processes used internal-image silver halide emulsions such as emulsions made by the conversion technique of Davey et al., U.S. Pat. No. 2,592,250, emulsions made by the techniques disclosed in British Pat. No. 1,011,062, and the like.

We have now found that photographic elements comprising at least one layer containing an unfogged, primitive, silver halide emulsion and a desensitizer compound or an electron acceptor can be imagewise-exposed to light of low intensity and then given a high-intensity flash exposure before development in a silver halide developer to provide a positive image.

In a highly preferred embodiment, photographic elements containing the emulsions of this invention are imagewise-exposed with a low-intensity light, given an over-all flash with a high-intensity light and then developed in a silver halide developer to provide a positive image. The imagewise exposure is given with a low-intensity light at 0.01 and preferably 0.05 second or longer and the over-all high-intensity flash is of a duration of less than 0.05 and preferably less than 0.01 second with optimum flash intensity and duration depending on the specific intensity used in the exposure step.

In one preferred embodiment, the primitive silver halide emulsions are substantially free of any sulfur or noblemetal sensitization, either internally or on the surface of the silver halide grain.

In another preferred embodiment of the invention, the electron acceptors used in the emulsions of this invention are polymethine dyes.

Generally, the primitive emulsions of this invention are those emulsions which can be made by a simple silver halide precipitation in the absence of chemical or physical sensitizing conditions. Generally, the emulsions can be described as primitive silver halide emulsions which are substantially free of any chemically induced sensitivity internally, as well as on the surface of the grain Preferably, the emulsions are those which can be defined as primitive emulsions, i.e., those derived from precipitation of an alkali metal halide and a water-soluble silver salt in the presence of a peptizer and are substantially free of any sulfur and/or noblemetal sensitization.

The silver halides of this invention are unfogged. Such emulsions contain only minimal developable surface latent images wherein processing for 5 minutes at 27° C. in Kodak Developer DK-19 will produce a density of less than 0.3 and preferably less than 0.2.

The surface of the silver halide grains can be spectrally sensitized with cyanine and merocyanine dyes, such as those described in U.S. Pat. Nos. 1,846,301 and 1,846,302, both issued Feb. 23, 1932, and 1,942,854 issued Jan. 9, 1934, all by Brooker; U.S. Pat. No. 1,990,507 by White issued Feb. 12, 1935; U.S. Pat. Nos. 2,112,140 issued Mar. 22, 1938, 2,165,338 issued July 11, 1939, 2,493,747 issued Jan. 10, 1950, and 2,739,964 issued Mar. 27, 1956, all by Brooker and White; U.S. Pat. No. 2,493,748 by Brooker and Keyes issued Jan. 10, 1950; U.S. Pat. No. 2,503,776 issued Apr. 11, 1950, and 2,519,001 issued Aug. 15, 1950, both by Sprague; U.S. Pat. No. 2,666,761 by Heseltine and Brooker issued Jan. 19, 1954; U.S. Pat. No. 2,734,900 by Heseltine issued Feb. 14, 1956; and U.S. Pat. No. 2,739,149 by VanLare issued Mar. 20, 1956; and Kodak Limited British Pat. No. 450,958 accepted July 15, 1936.

In accordance with this invention, the imagewise exposure can generally be made by any conventional technique including high-intensity, low-intensity, daylight exposure and the like. Generally, a wider variety of imagewise-exposure conditions can be used with present emulsions compared with the converted-type emulsions of the prior art. In embodiments where the photographic elements are imagewise-exposed, given an overall flash and then developed, the imagewise exposure is generally a low-intensity exposure of at least 0.01 second and, in highly preferred embodiments, at least 10 seconds in duration, and the flash exposure is a higher-intensity exposure of less than 0.05 second and preferably less than $10^{-2}$ seconds wherein said flash has at least 10 times the intensity of the imagewise exposure. Typical useful intensities for the imagewise exposure are generally in the range of about $5 \times 10^{-5}$ to about $5 \times 10^{-8}$ watts/cm.$^2$. However, lower intensities in the magnitude of $1 \times 10^{-12}$ watts/cm.$^2$ can be used for the imagewise exposure, such as those encountered in photographic systems used in astronomy. When extremely low-intensity exposures are used, the intensity of the over-all flash exposure is generally at least $5 \times 10^{-4}$ watts/cm.$^2$ or greater.

The developing compositions which can be used in the processes of the present invention can be either total-image developing compositions which contain silver halide solvents or surface-image developing compositions. Kodak DK-19 developer, referred to herein, is described in the *Handbook of Chemistry and Physics*, 39th Ed. 1957, Chemical Rubber Publishing Co., Cleveland Ohio, p. 3060, and has the following composition:

| | |
|---|---|
| water, about (50° C) | 500.0 cc |

-continued

| | |
|---|---|
| Elon (trademark for N-methyl-p-amino-phenol sulfate) | 2.0 g |
| sodium sulfite | 90.0 g |
| hydroquinone | 8.0 g |
| sodium carbonate, monohydrated | 52.5 g |
| potassium bromide | 5.0 g |
| water to make | 1.0 liter. |

In certain preferred embodiments, the developing compositions utilized are surface developers.

It is understood that the term "surface developer" encompasses those developers which will reveal the surface latent image on a silver halide grain but will not reveal substantial internal latent image in an internal image-forming emulsion employing conditions generally used to develop a surface-sensitive silver halide emulsion. The surface developers can generally utilize any of the silver halide developing agents or reducing agents, but the developing bath or composition is generally substantially free of a silver halide solvent (such as water-soluble thiocyanates, water-soluble thioethers, thiosulfates, ammonia and the like) which will crack or dissolve the grain to reveal substantial internal image. Low amounts of excess halide are sometimes desirable in the developer or incorporated in the emulsion as halide-releasing compounds, but high amounts are generally avoided to prevent substantial cracking of the grain, especially with respect to iodide-releasing compounds.

Typical silver halide developing agents which can be used in the developing compositions of this invention include hydroquinones, catechols, aminophenols, 3-pyrazolidones, ascorbic acid and its derivatives, reductones, phenylenediamines and the like or combinations thereof. The developing agents can be incorporated in the photographic elements wherein they are brought in contact with the silver halide after exposure; however, in certain embodiments they are preferably employed in the developing bath.

The emulsions of this invention comprise electron acceptors, which are referred to in some documents as desensitizers. The concentrations of the electron acceptors will vary with silver halide composition, average grain size, distribution of grain size, etc. In certain preferred embodiments, very good results are obtained when the electron acceptors are added to monodispersed silver halide emulsions in concentrations of generallly 1 mg. to 2 g. per mole of silver and preferably from 10 to 200 mg. per mole of silver.

Generally, the densensitizers or electron acceptors useful in the emulsion combinations of this invention are those compounds having a reduction potential or cathodic half-wave potential ($E_c$) more positive than −1.0. In certain embodiments, the useful electron acceptors also have an anodic halfwave potential more positive than +0.4 and preferably more positive than +1.0. The halfwave potentials can be measured as disclosed in Illingsworth, U.S. Pat. No. 3,501,307 issued Mar. 17, 1970; for example, the cathodic measurements can be made with a $1 \times 10^{-4}$ molar solution of the electron acceptor in a solvent, such as methanol which is 0.05 molar in lithium chloride using a dropping mercury electrode with the polarographic halfwave potential for the most positive cathodic wave being designated $E_c$. In the measurement, the reference electrode can be an aqueous silver — silver chloride (saturated potassium chloride) electrode at 20° C. Electrochemical measurements of this type are known in the art and are described in *New Instrumental Methods in Electrochemistry*, by Delahay, Interscience Publishers, New York, New York, 1954; *Polarography*, by Kolthoff and Lingane, 2nd Edition, Interscience Publishers, New York, New York, 1952; *Analytical Chemistry*, 36, 2426 (1964), by Elving; and *Analytical Chemistry*, 30, 1576 (1958) by Adams. Plus and minus signs are according to IUPAC (International Union of Pure and Applied Chemistry) Stockholm Convention, 1953.

In a preferred embodiment of this invention, the desensitizers are methine dyes, generally referred to as monomethine and/or polymethine dyes. Generally, these methine dyes include those which are useful in direct-positive silver halide emulsions as electron acceptors.

In certain preferred embodiments, the useful polymethine dyes of this invention can be characterized as containing at least one desensitizing nucleus. As used herein and in the appended claims, "desensitizing nucleus" refers to those nuclei which, when converted to a symmetrical carbocyanine dye and added to a gelatin silver chlorobromide emulsion containing 40 mole percent chloride and 60 mole percent bromide, at a concentration of from 0.01 to 2.0 grams dye per mole of silver, cause by electron trapping at least about an 80 percent loss in the blue speed of the emulsion when sensitometrically exposed and developed 3 minutes in Kodak Developer D-19 at room temperature. Advantageously, the desensitizing nuclei are those which, when converted to a symmetrical carbocyanine dye and tested as just described, essentially completely densensitize the test emulsion to blue radiation (i.e., cause a loss of more than about 90 to 95 percent of speed to blue radiation).

An especially useful class of electron-accepting compounds which can be used in the photographic silver halide emulsions of this invention is cyanine dyes, particularly imidazoquinoxaline dyes, such as described in Brooker et al., U.S. Pat. No. 3,431,111 issued Mar. 4, 1969. Very good results are obtained with cyanine dyes containing an indole nucleus aromatically substituted in the 2 position, i.e., a cyanine dye containing a 2-aromatically substituted indole nucleus such as disclosed in U.S. Pat. No. 3,314,796 issued Apr. 18, 1967. One useful class of spectral-sensitizing, electron acceptors is the bis-(1-alkyl-2-phenylindole-3)trimethine cyanine described by Coenen et al, U.S. Pat. No. 2,930,694 issued Mar. 29, 1960. Another useful class of dimethine cyanine dyes of this type is described in British Pat. No. 970,601.

Still othere classes of useful spectral-sensitizing electron acceptors are the cyanine and merocyanine dyes in which at least one nucleus and preferably two nuclei contain desensitizing substituents such as $NO_2$, e.g., 3,3′-diethyl-6,6′-dinitrothiacarbocyanine chloride, as shown in British Pat. No. 723,019.

The electron acceptors or desensitizers can be used in the photographic silver halide emulsions of this invention in widely varying concentrations. However, such compounds are preferably employed at concentrations in the range of about 10 mg to about 200 mg of the compound per mole of silver halide. Specific examples of suitable polymethine electron acceptors include the following:

DYE (A) 1,1′-dimethyl-2,2′-diphenyl-3,3′-indolocarbocyanine bromide

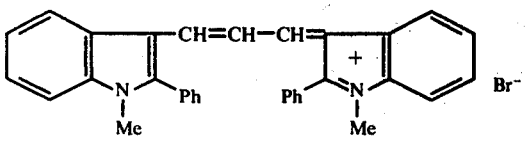

DYE (B) 2,2′-di-p-methoxyphenyl-1,1′-dimethyl-3,-3′-indolocarbocyanine bromide

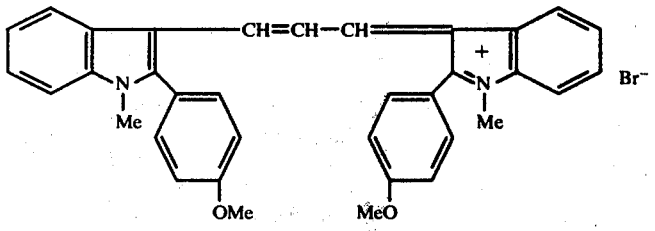

DYE (C) 1,1′-dimethyl-2,2′,8-triphenyl-3,3′-indolocarbocyanine perchlorate

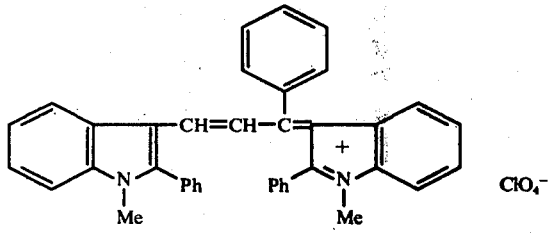

DYE (D) 1,1′,3,3′-tetraethylimidazo[4,5-b]quinoxalinocarbocyanine chloride

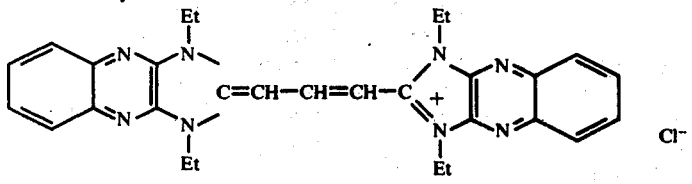

DYE (E) 6,6′,7,7′-tetrachloro-1,1′,3,3′-tetraphenyl-1H-imidazo[4,5-b]quinoxalinocarbocyanine p-toluenesulfonate

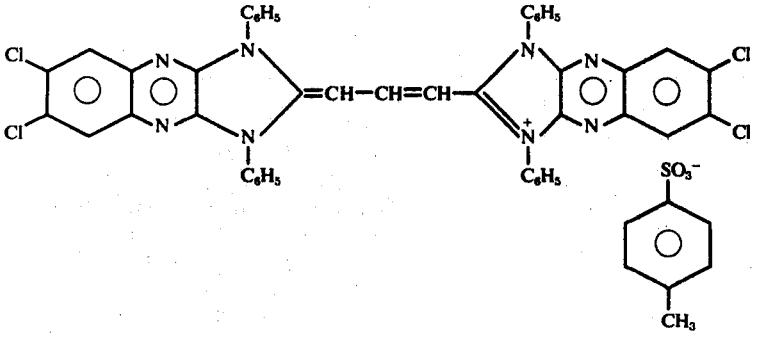

DYE (F) 3,3′-diethyl-8,9-diaza thiacarbocyanine iodide

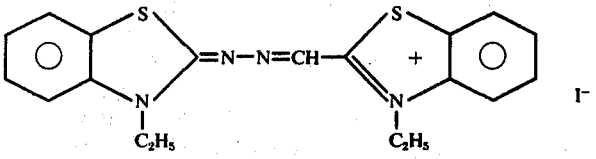

DYE (G) 1,1′,3,3′-tetraethyl-1H-imidazo[4,5-b]-quinoxalinocarbocyanine chloride

-continued

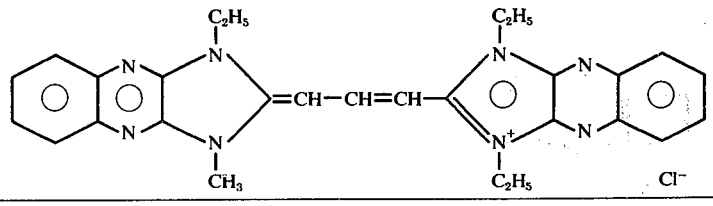

Additional examples include phenosafranine, pinacryptol yellow, 5-m-nitrobenzylidenerhodanine, 3-ethyl-5-m-nitrobenzylidenerhodanine, 3-ethyl-5-(2,4-dinitrobenzylidene)rhodanine, 5-o-nitrobenzylidene-3-phenylrhodanine, 1′,3-diethyl-6-nitrothia-2′-cyanine iodide, 4-nitro-6-chlorobenzotriazole, 3,3′-diethyl-6,6′-dinitro-9-phenylthiacarbocyanine iodide, 2-(p-dimethylaminophenyliminomethyl(benzothiazole ethoethyl sulfate, crystal violet, 3,3′-diethyl-6,6′-dinitrothiacarbocyanine ethyl sulfate, 1′,3-diethyl-6-nitrothia-2′-cyanine iodide, 1,3-diamino-5-methylphenazinium chloride, 4-nitro-6-chlorobenzotriazole, 3,3′-di-p-nitrobenzylthiacarbocyanine bromide, 3,3′-di-p-nitrophenylthiacarbocyanine iodide, 3,3′-di-o-nitrophenylthiacarbocyanine perchlorate, 3,3′-dimethyl-9-trifluoromethylthiacarbocyanine iodide, 9-(2,4-dinitrophenylmercapto)-3,3′-diethylthiacarbocyanine iodide, bis(4,6-diphenylpyryl-2)-trimethincyanine perchlorate, anhydro-2-p-dimethylaminophenyliminomethyl-6-nitro-3-(4-sulfobutyl)benzothiazolium hydroxide, 1-(2-benzothiazolyl)-2-(p-dimethylaminostyryl)-4,6-diphenylpyridinium iodide, 2,3,5-triphenyl-2H-tetrazolium chloride, 2-(4-iodophenyl)-3-(4-nitrophenyl)-5-phenyltetrazolium chloride, 1-methyl-8-nitroquinolinium methyl sulfate, 3,6-bis[4-(3-ethyl-2-benzothiazolinylidene)-2-butenylidene]-1,2,4,5-cyclohexanetetrone and the like.

An especially useful class of spectral-sensitizing electron acceptor is trimethine cyanine dye containing a 2-aromatically substituted indole nucleus attached by the 3-carbon atom thereof to the methine chain. Dyes of this type are described by Coenen et al. in U.S. Pat. No. 2,930,694 issued Mar. 29, 1960, and British Pat. No. 970,601 (and corresponding Belgian Pat. No. 630,911). A preferred class of spectrally sensitizing electron acceptors is dye containing an imidazo[4,5-b]quinoxalinium salt moiety, such as disclosed in Brooker et al, Belgian Pat. No. 660,253 issued Mar. 15, 1965. In these dyes, the imidazo[4,5-b]quinoxaline nucleus is attached, through the 2-carbon atom thereof, to the methine chain.

Another class of highly useful polymethine dyes is that having the following formula:

Formula 1

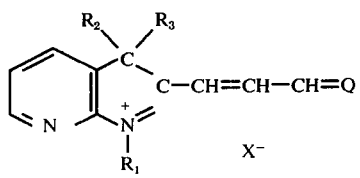

wherein $R_1$, $R_2$ and $R_3$ each represents an alkyl group such as methyl, ethyl, propyl or butyl, or an aryl group such as phenyl; X represents an anion, such as chloride, iodide, bromide, p-toluenesulfonate, methyl sulfate, perchlorate, thiocyanate, sulfonate, bromide, etc.; and Q represents the atoms necessary to complete a nucleus to form a trimethine cyanine dye, such as a 6-nitrobenzothiazole nucleus, an imidazo[4,5-b]quinoxaline nucleus or pyrrolo[2,3-b]pyridine nucleus, e.g.,

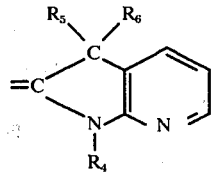

wherein $R_4$, $R_5$ and $R_6$ each represents a value selected from those given for $R_1$, $R_2$ and $R_3$. A typical specific useful dye of this class is 1,1′,3,3,3′,3′-hexamethylpyrrolo[2,3-b]pyriodcarbocyanine salt (e.g., perchlorate).

One useful group of trimethine cyanine dyes having 2-aromatically substituted indole nuclei has the following general formula:

Formula 2

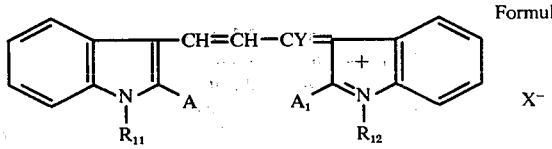

wherein X has the meaning given above; A represents an aryl substituent, such as phenyl; $R_{11}$ and $R_{12}$ each represents an alcohol radical, e.g., an alkyl substituent (including substituted alkyl) and preferably containing from about 1 to 8 carbon atoms, such as methyl, ethyl, propyl, butyl or octyl, or sulfoalkyl such as sulfopropyl or sulfobutyl, sulfatoalkyl such as sulfatopropyl or sulfatobutyl, or carboxyalkyl such as carboxyethyl or carboxybutyl; and Y represents a substituent selected from the group consisting of a hydrogen atom, an aryl group. such as phenyl, and alkyl (e.g., methyl, ethyl, propyl or butyl) or alkoxy (e.g., methoxy, ethoxy or propoxy) substituted phenyl groups, or a heterocyclic aromatic group, such as thiophene radical.

Symmetrical imidazo[4,5-b]quinoxaline trimethine cyanine dyes, wherein each nucleus is attached through the 2-carbon atom thereof to the methine chain, are useful in the practice of this invention. Typical of such dyes are those having the following general formula:

Formula 3

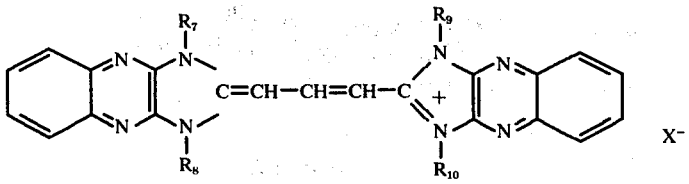

wherein X has the meaning given above; and $R_7$, $R_8$, $R_9$ and $R_{10}$ each represents a substituent such as alkyl, e.g., methyl, ethyl, propyl or butyl. Reference is made to Brooker et al, Belgian Pat. No. 660,253 issued Mar. 15, 1965, for other classes and specific examples of dyes containing an imidazo[4,5-b]quinoxaline nucleus which are useful herein.

The silver halide emulsions of this invention can be made by any of the precipitation and ripening procedures used for making primitive silver halide grains. Typical procedures include single-jet procedures, double-jet procedures, procedures utilizing automatic proportional control means to maintain specified pAg and pH, procedures using ripening agents such as thiocyanates, thioethers and/or ammonia, procedures utilizing an increase in flow rates as disclosed in Wilgus, U.S. Ser. No. 11,838 filed Feb. 16, 1970, hot nucleation procedures as disclosed in Musliner, U.S. Ser. No. 31,351 filed Apr. 23, 1970, and the like.

The silver halide compositions made for use in the systems of this invention are preferably monodispersed, and in some embodiments are preferably large-grain emulsions made according to Wilgus, U.S. Ser. No. 11,838, which is incorporated herein by reference. The monodispersed emulsions are those which comprise silver halide grains having a substantially uniform diameter. Generally, in such emulsions no more than about 5%, by weight, of the silver halide grains smaller than the mean grain size and/or no more than about 5%, by number, of the silver halide grains larger than the mean grain size vary in diameter from the mean grain diameter by more than about 40%. Preferred photographic emulsions of this invention comprise silver halide grains, at least 95%, by weight, of said grains having a diameter which is within 40%, preferably within about 30%, of the mean grain diameter. Mean grain diameter, i.e., average grain size, can be determined using conventional methods, e.g., such as projective area as shown in an article by Trivelli and Smith entitled "Empirical Relations between Sensitometric and Size-Frequency Characteristics in Photographic Emulsion Series" in *The Photographic Journal*, Vol. LXXIX, 1939, pp. 330–338. The aformentioned uniform size distribution of silver halide grains is a characteristic of the grains in monodispersed photographic silver halide emulsions. Silver halide grains having a narrow size distribution can be obtained by controlling the conditions at which the silver halide grains are prepared using a doublerun procedure. In such a procedures, the silver halide grains are prepared by simultaneously running an aqueous solution of a water-soluble silver salt, for example, silver nitrate, and a water-soluble halide, for example, an alkali metal halide such as potassium bromide, into a rapidly agitated aqueous solution of a silver halide peptizer, preferably gelatin, a gelatin derivative or some other protein peptizer. The pH and the pAg employed in this type of procedure are interrelated. For example, changing one while maintaining the other constant at a given temperature can change the size-frequency distribution of the silver halide grains which are formed However, generally the temperature is about 30° to about 90° C., the pH is up to about 9, preferably 4 or less, and the pAg is up to about 9.8. Suitable methods for preparing photographic silver halide emulsions having the required uniform particle size are disclosed in an article entitled "Ia: Properties of Photographic Emulsion Grains", by Klein and Moisar, *The Journal of Photographic Science*, Vol. 12, 1964, pp. 242–251; an article entitled "The Spectral Sensitization of Silver Bromide Emulsions on Different Crystallographic Faces", by Markocki, *The Journal of Photographic Science*, Vol. 13, 1965, pp. 85–89; and article entitled "Studies on Silver Bromide Sols, Part I. The Formation and Aging of Monodispersed Silver Bromide Sols", by Ottewill and Woodbridge, *The Journal of Photographic Science*, Vol. 13, 1965, pp. 98–103; and an article entitled "Studies on Silver Bromide Sols, Part II. The Effect of Additives on the Sol Particles", by Ottewill and Woodbridge, *The Journal of Photographic Science*, Vol. 13, 1965, pp. 104–107.

The photographic emulsions and elements described in the practice of this invention can contain various colloids alone or in combination as vehicles, binding agents and various layers. Suitable hydrophilic materials include both naturally occurring substances such as proteins, for example, gelatin, gelatin derivatives, cellulose derivatives, polysaccharides such as dextran, gum arabic and the like; and synthetic polymeric substances such as water-soluble polyvinyl compounds like poly(-vinylpyrrolidone), acrylamide polymers and the like.

The described photographic emulsion layers and other layers of a photographic element employed in the practice of this invention can also contain, alone or in combination with hydrophilic, water-permeable colloids, other synthetic polymeric compounds such as dispersed vinyl compounds such as in latex form and particularly those which increase the dimensional stability of the photographic materials. Suitable synthetic polymers include those described, for example, in U.S. Pat. Nos. 3,142,568 by Nottorf issued July 28, 1964; 3,193,386 by White issued July 6, 1965; 3,062,674 by Houck et al. issued Nov. 6, 1962; 3,220,844 by Houck et al. issued Nov. 30, 1965; 3,287,289 by Ream et al. issued Nov. 22, 1966; and 3,411,911 by Dykstra issued Nov. 19, 1968; particularly effective are those water-insoluble polymers or latex copolymers of alkyl acrylates and methacrylates, acrylic acid, sulfoalkyl acrylates or methacrylates, those which have cross-linking sites which facilitate hardening or curing, those having recurring sulfobetaine units as described in Canadian Pat. No. 774,054 by Dykstra, and those described in U.S. Pat. No. 3,488,708 by Smith issued Jan. 6, 1970.

The photographic layers and other layers of a photographic element employed and described herin can be coated on a wide variety of supports. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like. Typically, a flexible support is employed, especially a paper support, which can be partially acetylated or coated with baryta and/or an alpha-olefin polymer, particularly a polymer of an alpha-olefin containing 2 to 10 carbon atoms such as polyethylene, polypropylene, ethylenebutene copolymers and the like.

This invention may be used with elements designed for colloid transfer processes such as described in U.S. Pat. No. 2,716,059 by Yutzy et al.; silver salt diffusion transfer processes such as described in U.S. Pat. Nos. 2,352,014 by Rott, 2,543,181 by Land, 3,020,155 by Yackel et al. and 2,861,885 by Land; color image transfer processes such as described in U.S. Pat. Nos. 3,087,817, 3,185,567 and 2,983,606 by Rogers, 3,253,915 by Weyers et al., 3,227,550 by Whitmore et al., 3,227,551 by Barr et al., 3,227,552 by Whitmore and 3,415,644, 3,415,645 and 3,415,646 by Land, and U.S. Ser. Nos. 27,990 and 27,991, both filed Apr. 13, 1970; and imbibition transfer processes as described in U.S. Pat. No. 2,882,156 by Minsk.

This invention may be used with elements designed for color photography, for example, elements containing colorforming couplers such as those described in U.S. Pat. Nos. 2,376,679 by Frohlich et al., 2,322,027 by Jelley et al., 2,801,171 by Fierke et al., 2,698,794 by Godowsky, 3,227,554 by Barr et al. and 3,046,129 by Graham et al.; or elements to be developed in solutions containing color-forming couplers such as those described in U.S. Pat. Nos. 2,252,718 by Mannes et al., 2,592,243 by Carroll et al. and 2,950,970 by Schwan et al.; and in false-sensitized color materials such as those described in U.S. Pat. No. 2,763,549 by Hanson.

The invention can be further illustrated by the following examples of preferred embodiments thereof.

EXAMPLE 1

Formation of a direct-positive image

A cubic-grain silver bromide emulsion having an average grain size of about 0.2 micron is prepared by adding an aqueous solution of potassium bromide and an aqueous solution of silver nitrate simultaneously to a rapidly agitated aqueous gelatin solution at a temperature of 70° C. over a period of about 35 minutes with a constant pAg of 8.9. After washing in a conventional manner, the emulsion is spectrally sensitized with 70 mg. per mole of silver of the electron-accepting dye per mole of silver described as Dye VII in Litzerman, U.S. Pat. No. 3,505,070 issued Apr. 7, 1970 ($E_c = -0.64$; $E_a$ = greater than +1.0). The spectrally sensitized emulsion is then coated on an acetate film support at a coverage of 100 mg. of silver/ft.$^2$.

A sample of the coated emulsion is exposed imagewise on a Bausch and Lomb wedge spectrograph (0.3 log E steps) for ¼ second and then exposed uniformly by an Ascor electronic flash at a distance of 3 feet. The resulting exposed coating is processed for 5 minutes in an Elon-hydroquinone developer. A direct-positive image consisting of 8 steps in the blue region at 400 nm. and at 540 nm. is obtained having good maximum density.

The grains that do not receive the low-intensity, imagewise exposure, or desensitizing exposure, are the grains that develop to maximum density.

If the exposure sequence is reversed, only a feeble, slow reversal image is obtained.

EXAMPLE 2

A coating is prepared and processed in a manner simular to Example 1 except the electron-accepting dye in Example 1 is substituted with phenosafranine ($E_c = -0.54$; $E_a = +1.00$). A direct-positive image similar to Example 1 is obtained.

EXAMPLE 3

Formation of direct-positive images with different light sources

A coating prepared similar to Example 1 is given a 60-second, low-intensity, imagewise exposure to minus blue light by exposing the emulsion, with a 25-watt lamp at a distance of 10 inches, through two Kodak Wratten No. 16 filters. An over-all blue exposure is given through a Kodak Wratten 18A filter, and the exposed coating is processed for 5 minutes in a Elonhydroquinone developer. A good direct-positive image results.

The resulting direct-positive image is obtained if the over-all flash exposure immediately follows the image exposure and also when there is a long delay between exposures.

EXAMPLE 4

An emulsion is prepared as described in Example 1 and to separate samples of the emulsion are added the electron-accepting dyes indicated below in Table I. Dye concentrations of 100 mg per silver mole were employed in each instance. The emulsion samples containing dye were then coated on a film support at 100 mg of silver/ft$^2$ and imagewise exposed on a Bausch and Lomb Spectrograph. The coated samples were then exposed uniformly by an Ascor electronic flash at a distance of 3 feet and developed in Kodak Developer D-19. Each coating containing a dye having a cathode halfwave potential more positive than −1.0 volt and an anodic halfwave potential more positive than +0.4 volt produced an excellent direct-positive image, whereas the control dyes produced negative images only.

TABLE I

| Dye | $E_{ox}$(volts) | $E_{red}$(volts) | Image Obtained |
|---|---|---|---|
| Control-1 | +1.00 | −1.00 | Negative image; no reversal |
| Control-2 | +0.99 | −1.03 | Negative image; no reversal |
| (E) | +1.09 | −0.45 | Direct-positive image |
| (F) | +1.02 | −0.63 | Direct-positive image |
| (G) | +1.00 | −0.79 | Direct-positive image |

The control dyes are as follows:

Control-1 1,1′,3,3′-tetramethyl-2,2′-cyanine iodide

-continued

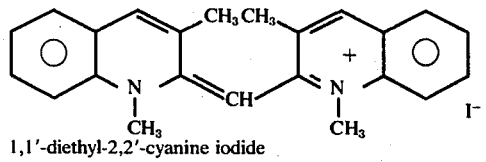

Control-2 1,1'-diethyl-2,2'-cyanine iodide

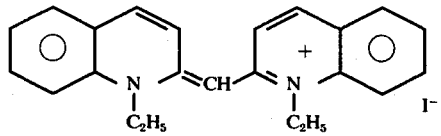

The invention has been described with particular reference to preferred embodiments thereof but it will be understood that variations and modifications can be effected within the spirit and scope of the invention.

We claim:

1. A process for producing a direct-positive image in a silver halide photographic element comprising 1. imagewise exposing for at least 0.01 second at an intensity of at least $1 \times 10^{-12}$ watt/cm$^2$ a photographic element comprising a support and coated theron at least one layer of a primitive, silver halide emulsion which contains 1 mg to 2 grams per mole of silver of an electron-accepting compound having a cathode halfwave potential more positive than −1.0 volt and an anodic halfwave potential more positive than +0.4 volt, said emulsion being derived from precipitation of an alkali metal halide and a water soluble silver salt in contact with a peptizer and in the absence of chemical or physical sensitizing conditions, the silver halide emulsion in the absence of exposure exhibiting a density of less than 0.3 when processed for 5 minutes at 27° C in a photographic developer having the following composition:

| | |
|---|---|
| water | 500.0 cc |
| N-methyl-p-amino-phenol sulfate | 2.0 g |
| sodium sulfite | 90.0 g |
| hydroquinone | 8.0 g |
| sodium carbonate, monohydrated | 52.5 g |
| potassium bromide | 5.0 g |
| water to make | 1.0 liter |

2. exposing said imagewise-exposed silver halide emulsion to an overall flash for less than 0.05 second at an intensity at least 10 times greater than the imagewise exposure and
3. developing said photographic element in silver halide surface-image developer which is substantially free of silver halide solvent.

2. A process according to claim 1 wherein said electron-accepting compound is a polymethine dye.

3. A process according to claim 1 wherein said image-wise exposure is a low-intensity exposure of 0.05 second or longer.

4. A process according to claim 1 wherein said electron-accepting compound is chosen from the class consisting of phenosafranine;

6,6',7,7'-tetrachloro-1,1',3,3'-tetraphenyl-1H-imidazo[4,5-b]quinoxalinocarbocyanine p-toluenesulfonate;

3,3'-diethyl-8,9-diaza thiocarbocyanine iodide; and 1,1',3,3'-tetraethyl-1H-imidazo[4,5-b]quinoxalinocarbocyanine chloride.

* * * * *